United States Patent [19]

Eckert

[11] Patent Number: 5,025,768

[45] Date of Patent: Jun. 25, 1991

[54] FUEL INJECTION SYSTEM FOR INTERNAL COMBUSTION ENGINES

[75] Inventor: Konrad Eckert, Stuttgart, Fed. Rep. of Germany

[73] Assignee: Robert Bosch GmbH, Stuttgart, Fed. Rep. of Germany

[21] Appl. No.: 271,263

[22] Filed: Nov. 15, 1988

[30] Foreign Application Priority Data

Dec. 22, 1987 [DE] Fed. Rep. of Germany ..... 3743532

[51] Int. Cl.[5] ..... F02M 37/04

[52] U.S. Cl. ..... 123/506; 123/447; 123/496; 123/494

[58] Field of Search ..... 123/447, 506, 458, 496, 123/504, 494

[56] References Cited

U.S. PATENT DOCUMENTS 4,546,749 10/1985 Igashira ..... 123/506
4,699,112 10/1987 Filippi ..... 123/506
4,718,391 1/1988 Rembold ..... 123/506
4,753,212 6/1988 Miyaki ..... 123/506
4,777,921 10/1988 Miyaki ..... 123/506

*Primary Examiner*—Carl Stuart Miller
*Attorney, Agent, or Firm*—Edwin E. Greigg; Ronald E. Greigg

[57] ABSTRACT

A fuel injection system for internal combustion engines, which has a fuel injection pump and an additional device for varying the injection quantity pumped to the injection nozzle from a pump work chamber; the additional device has a blocking piston acted upon from the pump work chamber, the deflection stroke of which is controlled by an electrically controlled valve by means of which the injection duration or the injection quantity can be controlled. The operative face on the blocking piston facing the pump work chamber is smaller than the face facing the control valve and the control valve is embodied as an ON/OFF valve.

26 Claims, 3 Drawing Sheets

FUEL INJECTION SYSTEM FOR INTERNAL COMBUSTION ENGINES

BACKGROUND OF THE INVENTION

The invention is based on a fuel injection system for internal combustion engines.

In a known fuel injection system of this type (German Offenlegungsschrift 30 11 097), the control chamber can be relieved in a throttled fashion via a control line the cross section of which is controlled by the electrically actuated valve, so that during the feed of the injection pump the blocking piston yields accordingly. The blocking piston, functioning like a reservoir, receives some pumped fuel. After the pump feed has ended, the blocking piston, driven by the restoring force, pumps this quantity of fuel to the injection nozzle, where it is injected; this assures that this quantity will also be supplied to the engine. The result is a prolongation of the injection duration, bringing about quieter engine idling.

The quantity of fuel received by the blocking piston during its deflection is equivalent to the quantity that flows, throttled, via the control valve; hence at relatively low rpm, when such quiet idling is particularly desirable, the relatively small quantities positively displaced by the blocking piston mean that relatively small control throttle cross sections must be established and maintained. This means additional problems in the event of a temperature change, because a temperature increase not only increases the viscosity but also changes the cross sections at such valves, so that a temperature change also necessitates a control correction. A further disadvantage of this system is that the control pressure is approximately subject to the injection pump feed pressure, which puts an extraordinary burden on the control chamber and control valve, with attendant disadvantages in terms of effecting control. When a plurality of fuel injection nozzles must be supplied in succession by the injection pump, there are typically differences in the opening and closing force of the nozzle, which correspondingly affects the backup pressure established in the pressure line and hence affects the force engaging the first face of the blocking piston. That, in turn, leads to differences among the injection durations of the various nozzles and above all means a relatively narrow range of tolerance for the magnitude of the restoring force engaging the blocking piston, because the return pressure of the blocking piston, which is determined by the restoring force and the first face, should be as low as possible, in order not to unnecessarily burden the outflow from the control chamber, yet it must in each case be greater than the closing pressure of the injection nozzle, in order to assure the required return feed prior to the closure of the injection nozzle.

In another injection system of this type (U.S. Pat. No. 4,546,749), the blocking piston and the control valve serve as an injection quantity determining device, in that during the fuel pumping by the injection pump the blocking piston always yields whenever the injection is to be terminated. Because of the opening of the magnetic valve, the pump feed pressure displaces the blocking piston toward low hydraulic pressure, until an outflow opening is opened by the blocking piston control edge facing toward the pump work chamber, and the remaining feed quantity of the injection pump flows out without pressure. In this case the restoring force is determined by the pressure of a feed pump upon the second face. Once again, there is the disadvantage that the control chamber and hence the magnetic valve are operating under high-pressure conditions, namely the pressure that likewise prevails in the injection pump work chamber. A further disadvantage is that the blocking piston stroke is relatively short and thus the working quantity flowing through the magnetic valve is relatively low; both these factors have a deleterious effect on control, and in particular on the accuracy of control.

OBJECT AND SUMMARY OF THE INVENTION

The fuel injection system according to the invention has an advantage over these known systems that during the blocking piston movement, because of the difference in surface area between the first face of the blocking piston acting in the deflection direction and its second face acting in the return feed direction, the volume moved in the control chamber is substantially larger than the volume moved upstream of the first face of the blocking piston. As a result, first, the pressure in the control chamber is substantially lower than in the pump work chamber, as a function of the relative areas involved, and thus is more easily controlled by an electrically actuated control valve, in particular a magnetic valve; on the other hand, because of the larger quantities moved through the control valve, more-precise time control by the control valve is attainable. Since the control valve merely opens and closes the control line, the control is not vulnerable to temperature changes; furthermore, an intermittent signal used in this case is easier to reproduce and to calculate.

In an advantageous feature of the invention, the blocking piston is embodied as a stepped piston, and the step face serves as the first face. Because of the variable guidance of the stepped piston in the housing, an annular chamber is created upstream of the first face that communicates directly with the pump work chamber or with the pressure line leading from the pump work chamber to the nozzle.

In another feature of the invention, the blocking piston is embodied in two parts, with positive and form-fitting engagement in, and a possible axial offset transversely to, the direction of adjustment of the two parts. Unlike a one-part stepped piston, in a two-part stepped piston, the pressure of the pump work chamber acts upon the face end of the piston of smaller diameter that is remote from the piston of larger diameter, while the control chamber is located upstream of the face end of the larger piston that is remote from the piston of smaller diameter. The advantage is, above all, that because of the independent guidance of the two pistons, a lesser axial offset of the bore receiving the pistons is not a functional disadvantage, and that less effort is needed to attain the radial sealing of the pistons. Thus, the larger piston can be slipped over the free end of the smaller piston, and for the sake of the necessary positive and form-fitting engagement, a restoring force in the form of a spring can engage the larger piston However, it is also possible for the smaller piston to be guided in a bushing of the injection pump housing, while the larger piston is contrarily guided in a bushing of the valve housing. In the fastening of the valve housing to the pump housing, a slight play effecting an axial offset of the two pistons is of no functional disadvantage.

In still another feature of the invention, the valve is embodied as a seat valve and is closable in the outflow direction. The advantages of such a valve are above all the quality of reciprocation and sealing, and the large opening cross section that is possible. Since in the control provided the valve need not open counter to pressure, and hence the control motor, for example the electromagnet, can be relatively weak, very short actuation times are possible, which is a necessary feature at high engine rpm and with the associated high valve switching frequency. Depending on the intended use, the valve may be embodied as closed, or open, when there is no current through it.

In another feature of the invention, a stroke transducer for the blocking piston is provided, so that the volume received in the blocking piston deflection stroke can be detected in combination with the crankshaft position at that time for use by an electronic control unit. The advantages of this kind of transducer arrangement are primarily that in terms of available space it is readily accommodated in the vicinity of the blocking piston, that the return signal for the pumping quantity and for the onset of pumping, for instance, can be direct, and that this stroke measurement can also be compared with the pump piston stroke measurement. The resultant electrohydraulic control unit functions largely autonomously, so that it is readily incorporated into a modular group with a mechanically regulated basic stage. This is especially advantageous because the invention is usable independently of the injection pump type, being applicable to distributor pumps, in-line pumps, and so forth.

In a further feature of the invention, the blocking piston serves in a manner known per se (German Offenlegungsschrift 30 11 097) as a reservoir, so that when the control valve is opened it deflects away from a corresponding quantity of fuel, the volume of which is equivalent to the stroke of the blocking piston times the area of the first face. Since this quiet-idle device is one that must be especially turned on, thereby enabling prolongation of the injection duration, for example by subdividing the injection or providing a pre-injection, the control valve is closed when it is without current. The quiet-idle device that prolongs the injection duration is not turned on unless the electronic control unit opens the magnetic valve.

In yet another feature of the invention, the return feed pressure, determined by the restoring force and the first face, is smaller than the opening pressure of the injection nozzle. This assures that the fuel pumped by the injection pump when the control valve is open displaces the blocking piston first, before the injection nozzle opens to begin the injection. It is understood that given the surface areas brought into play, the opening pressure of an injection nozzle is substantially higher than the closing pressure of this nozzle, which can also be termed the pressure that keeps the valve open. It is also understood that the surface area acting in the opening direction is substantially larger when the nozzle is open than when it is closed.

In another feature of the invention, this return feed pressure is greater than the closing pressure of the injection nozzle, so that before the injection nozzle can close and the pump piston begins its intake stroke, the stored quantity pre-stored in the blocking piston is injected, after which, after the return feed pressure drops, the injection nozzle closes.

In another advantageous feature of the invention, the blocking piston and control valve serve as a device for metering the quantity of fuel to be injected; the supply onset takes place by blockage of the blocking piston during fuel pumping out of the pump work chamber, and the return feed pressure determined by the restoring force and the first face is less than both the opening and the closing pressure of the injection nozzle. The latter factor is necessary, so that after the end of the injection piston pumping and before the pump piston intake stroke begins, fuel by the blocking piston will not be resupplied. The return feed by the blocking piston then takes place during the intake stroke, directly into the pump work chamber. In the apparatus according to the invention, the kind of injection quantity regulation is especially advantageous, because as a result of the stepping of the blocking piston and hence the increase in the working quantity at the control valve, or because the pressure is lower in the control chamber than in the pump work chamber, and because of the small idle volumes ensuing, precise control of both the injection quantity and the onset and end of supply is possible, even with magnetic valves. Neither a separate injection timing adjuster, nor a separate compensatory control means for outflow quantities of the kind required in some conventional quiet-idle control systems, is accordingly necessary.

It is possible to provide that the end of supply be effected by the opening of a relief conduit by the blocking piston. The control valve should also advantageously be open when without current, so that if the electrical current fails, engine racing will be avoided. In the use of the apparatus according to the invention for fuel quantity control as described here, there is also the advantage that this electrohydraulic unit functions largely autonomously, so that it can be modularly integrated with an injection system that functions with a mechanically regulated basic stage, as is the case for instance with in-line pumps. Expansion stages are also conceivable, in which only the supply onset, or only the injection quantity, is controlled by the blocking piston; in that case this may under certain conditions be combined with end-of-supply control effected by an opening at the pump piston.

By the embodiment of the blocking piston and control valve, very high-frequency hydraulic disturbance frequencies are decoupled from the control valve by the mass of the blocking piston or pistons. Such high-frequency pressure fluctuations are of high amplitude and are particularly disruptive with ON/OFF controls, since even slight shifts in the phase cause major changes in the flow quantity in the opening or closing range. A further superior advantage of the blocking piston according to the invention, for both of the basic areas of application here, is that during the entire process, a minimum pressure is maintained on the high-pressure side by the restoring force, and this minimum pressure stabilizes the high-pressure side by assuring a kind of backup pressure. Once again, hydraulic disturbance oscillations are lessened.

A further advantage, especially for injection systems for smaller engines with smaller injection quantities, is that because of the great freedom in design of the step-up at the blocking piston, the quantity to be controlled by the control valve can be increased, or the control pressure can be decreased, in such a way that both factors are reliably controllable. These advantages are attainable without having to shorten the transducer measurement path, because this path depends on the stroke of the blocking piston, which in turn is determined by the cross section of the first face.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
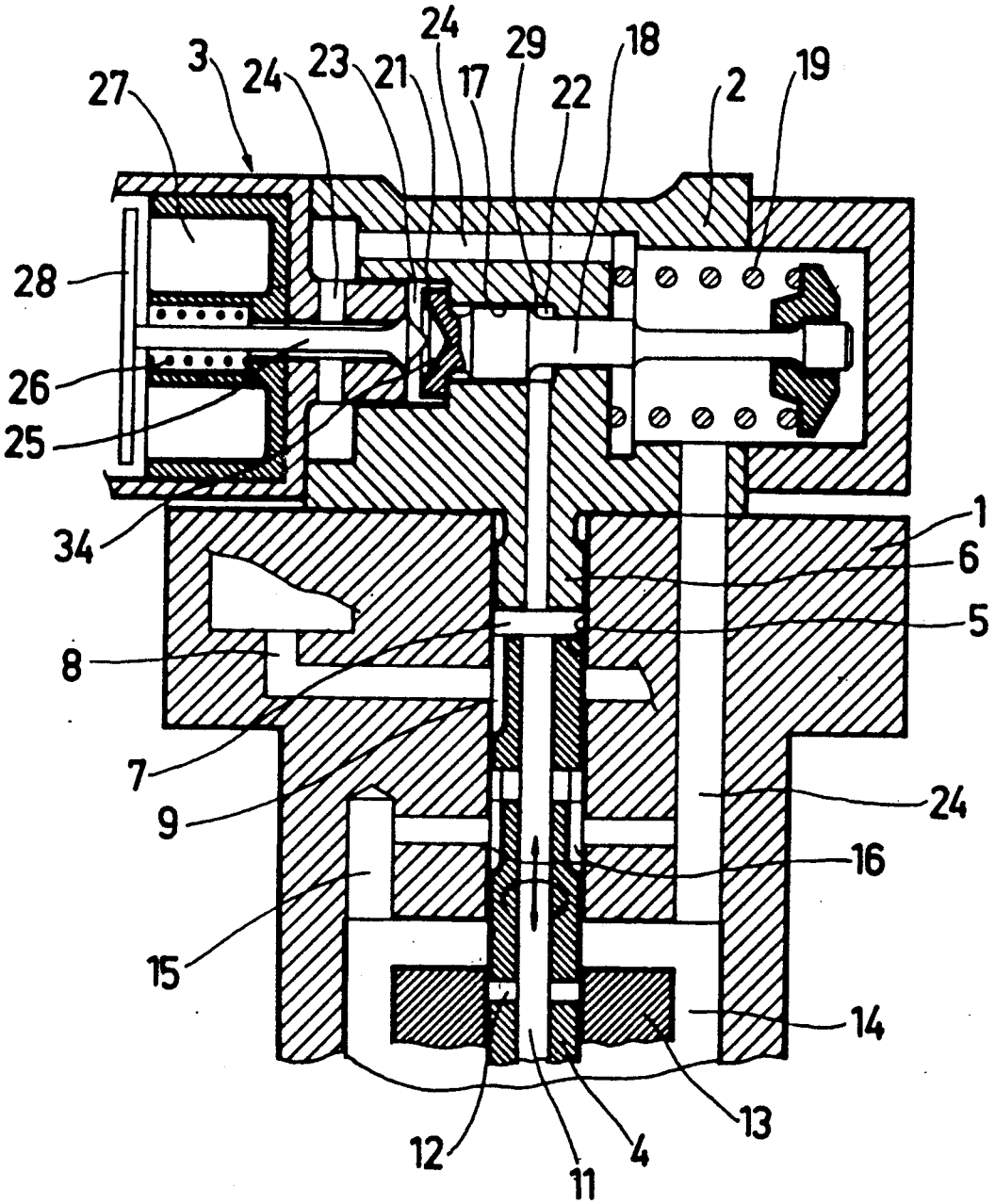
FIG. 1 shows a partial fuel injection pump with an attached control valve and a stepped blocking piston, as a quiet-idle control means, seen in a longitudinal section in a cutaway view.
Figure 2:
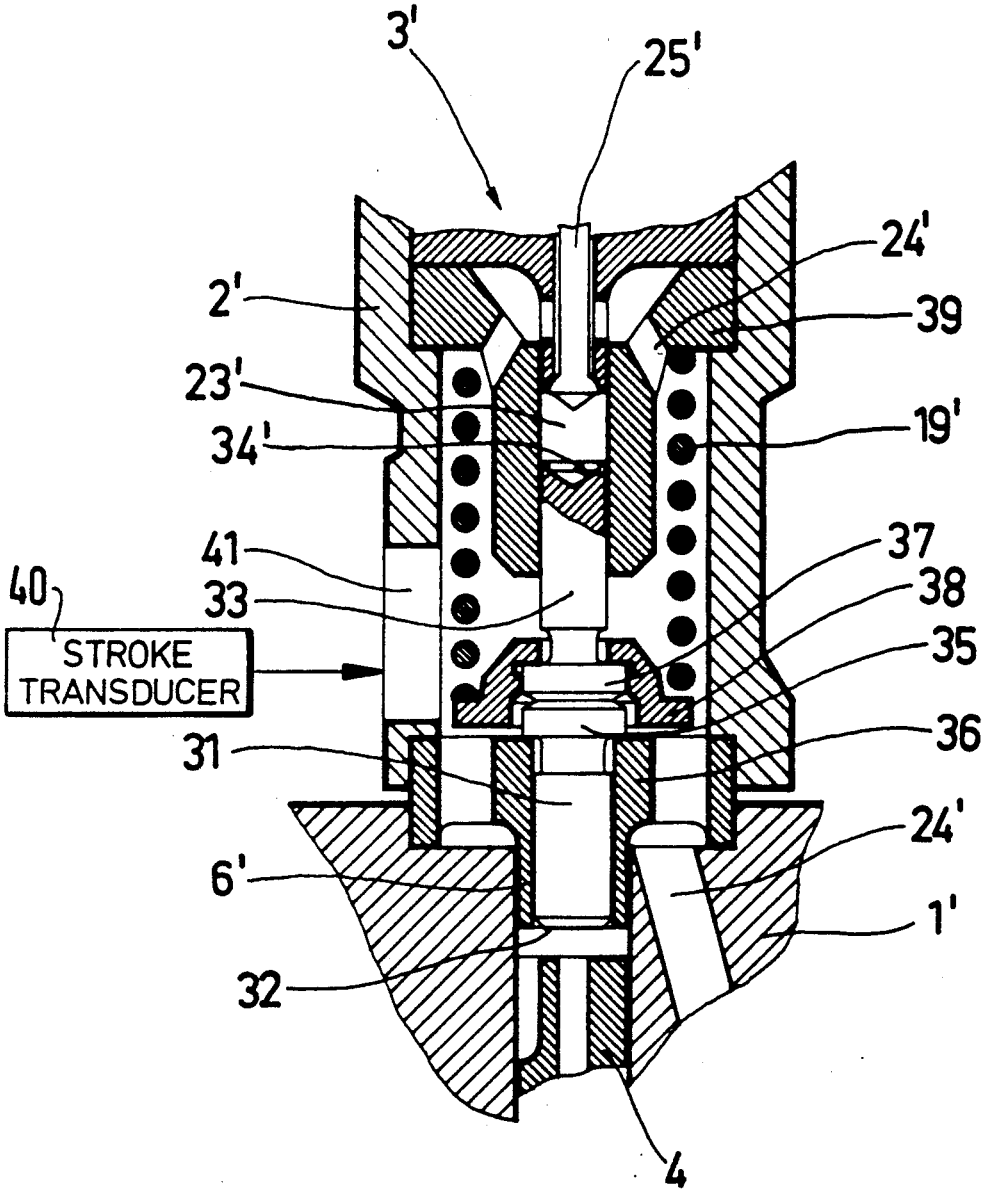
FIG. 2 is a corresponding partial view of a second exemplary embodiment with a two-part blocking piston.
Figure 3:
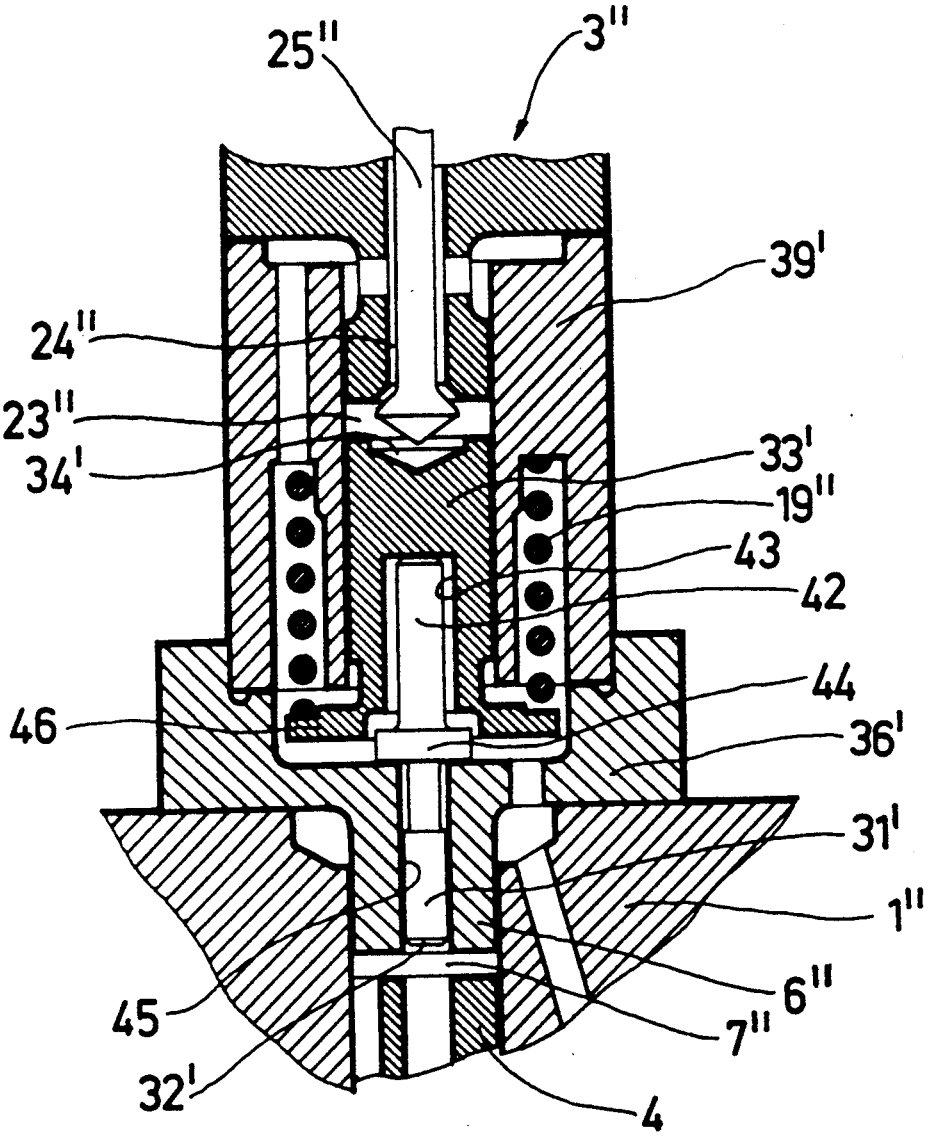
FIG. 3 is a corresponding partial view of a third exemplary embodiment, again with a two-part blocking piston as an injection quantity control device.

In the ensuing description, elements in the three exemplary embodiments that are equivalent to one another are provided with the same reference numerals; if the parts are embodied differently, the numerals are provided with primes to distinguish them. All three exemplary embodiments are shown highly schematically, in order to make the principle of the invention clear. FIGS. 1 and 2 show partial exemplary embodiments used for prolonging the injection duration; FIG. 3, contrarily, shows the use of the invention as a metering device for the fuel injection quantity, as an example. The essential difference between the use for injection duration prolongation and that for fuel metering is that in the first case the control valve is closed when without current, and the fuel metering takes place via a device on the fuel injection pump itself, while in the second case the control valve is open when without current, and an injection duration prolongation, if desired, must be effected by some other means, not shown.

In the exemplary embodiment shown in FIG. 1, the housing 2 of a control device that cooperates with a magnetic valve 3 which serves as a control valve is disposed on a housing 1 of a fuel injection pump.

In the pump housing 1, an injection pump piston 4 is set into simultaneous reciprocation and rotation by well known means not shown; this pump piston 4, with a cylinder bore 5 and an end of a fitting 6 of the housing 2 that protrudes into the cylinder bore 5, defines a pump work chamber 7.

The fuel injection pump supplies a plurality of pressure lines 8 leading to an internal combustion engine, not shown; only one of the pressure lines 8 is shown. During the upward compression stroke of the pump piston 4, fuel is pumped out of the pump work chamber 7 into a respective pressure line 8, via a longitudinal distributor groove 9 disposed on the piston jacket face which discharges into the pump work chamber 7. During one rotation of the pump piston 4, a number of compression strokes equivalent to the number of pressure lines 8 takes place, and upon each compression stroke, one pressure line 8 is opened by the longitudinal distributor groove 9. There is a central bore 11 in the pump piston, with radial bores 12 branching off from it, which are controlled by a control slide 13 that is axially displaceable on the pump piston 4. During the compression stroke of the pump piston 4, as soon as the radial bores 12 emerge from the control slide 13, the injection is interruped; that is, to attain this end of supply, the remaining fuel in the pump work chamber 7 is pumped into a suction chamber 14, from which the pump work chamber 7 is supplied with fuel during the intake stroke and in which a low minimum pressure prevails. Naturally, for the case of the intended injection duration prolongation, with temporary storage by means of the blocking piston, it must be provided that after the emergence of the radial bores, the fuel quantity stored in the annular chamber 22 proceeds only to injection and does not flow out without pressure. This can be effected by suitable edge control provisions or check valve control provisions, not described in detail here.

During the downward intake stroke of the pump piston 4, a connection is established between the suction chamber 14 and the pump work chamber 7, via a suction line 15 and via longitudinal grooves 16 disposed in the jacket face of the pump piston 4. The number of longitudinal grooves 16 corresponds to the number of pressure lines 8, so that upon each of the intake strokes of the pump piston 4, which also correspond in number to the number of pressure lines 8, this suction connection is established.

A stepped bore 17 for receiving a blocking piston 18 is provided in the housing 2 of the control device. The blocking piston 18 is urged by a restoring spring 19 into its outset position, which is determined by a stop 21. An annular chamber 22 is formed between the stepped bore 17 and the blocking piston 18. The stop 21 extends into a control chamber 23, which has a control line 24 that is controlled by the magnetic valve 3 which control line 24 discharges into the suction chamber 14.

The magnetic valve, embodied as a seat valve that is closed when no current flows through it, has a movable valve element 25, which is urged by a spring 26 in the closing direction. The electromagnet, acting in the opening direction, has a coil 27 and an armature 28. In this case, the annular face 29 formed in the annular chamber 22 by the step serves as the first face.

The apparatus according to the invention functions as follows.

To attain a prolongation of injection duration, for instance by interrupting the injection or by storing an injection quantity, the magnetic valve 3 is opened during the compression stroke of the pump piston 4 by an electronic control unit (not shown), so that because of the feed pressure of the pump piston 4, the pressure building up in the annular chamber 22 upstream of the annular face displaces the stepped piston 18 toward the magnetic valve 3, counter to the restoring spring 19 and counter to the low pressure of the control chamber 23 engaging the second face 34 of the blocking piston. Since the hydraulic blocking volume located in the control chamber 23 is kept as low as possible, in particular by reducing the size of any idle volumes, this control functions very precisely. Because of the stepped piston embodiment, namely the ratio of the annular face 29 to the second face 34, the volume of fluid flowing through the magnetic valve is substantially greater than the fuel volume flowing after it into the annular chamber 22 from the pump work chamber 7. The pressure, too, is lower by the same ratio in the control chamber 23 than in the annular chamber 22 and hence is more easily controlled. As soon as the magnetic valve 3 closes, by the shutoff of current to the magnetic coil 27, the blocking piston 18 stops, so that a pressure can be built up in the pump work chamber 7 that effects an opening of the injection valve (not shown) that is disposed at the end of the pressure line 8. This opening of the magnetic valve 3 can take place prior to the onset of the compression stroke of the pump piston 4, or it may be desirable to effect it during the pumping stroke. In the first case, a certain quantity is stored in the annular chamber 22 before the injection begins, while in the second case the injection is interrupted, and then continued again after the closure of the magnetic valve 3. In each case, the fuel quantity stored in the annular chamber 22 can be pumped through the injection nozzle for injection after the end of the compression stroke of the pump piston 4, by means of the blocking piston 18 and with the aid of the restoring spring 19. In this pumping process, fuel at low pressure follow after, flowing out of the suction chamber 14 into the control chamber 23 to fill it, via the control line 24 and the valve element 25 that functions like a check valve. The quantity of fuel diverted from the metered fuel quantity by the annular chamber 22 is compensated for in this return pumping process. Since the return pumping takes place at a time before the injection valve has closed, the return pumping pressure defined by the annular face of the stepped piston and by the spring 19 must be higher than the closing pressure of the injection nozzle. If the storage by the blocking piston is intended to take place prior to the injection, then in any case this return pumping pressure must be lower than the opening pressure of the injection nozzle —which is always higher than the closing pressure—in order to prevent the injection valve from opening before the reservoir has been filled in accordance with the opening duration of the magnetic valve 3.

In each case, the control of the magnetic valve is merely an intermittent signal, which can be generated relatively simply by means of an electronic control unit. The control parameter values can be picked up by a simple stroke transducer, not shown here, on the blocking piston 18, or may typically be in the form of a constant cam angle size, or can be picked up by other parameter transducers, such as needle stroke transducers for the injection nozzle and the like.

In the second exemplary embodiment shown in FIG. 2, the basic pump is again assumed to be a distributor injection pump, but in this case the additional device is embodied as a quiet-idle device of a different construction; in particular, the blocking piston is in two parts. Here, the blocking piston comprises an intermediate piston 31 axially aligned with respect to piston 4, which has a first end face 32, directly jointly defining the pump work chamber, and a control piston 33, which with the second face 34' defines the control chamber 23'. The movable valve element 25' of this magnetic valve 3' functions as in the first exemplary embodiment, and the control line 24' likewise leads to the suction chamber (not shown here) of the injection pump. The intermediate piston 31 has a stop 35, which cooperates with a housing part 36 of the apparatus and on which the fitting 6' is disposed. A head 37 of the control piston 33 rests positively and form-fittingly on the stop head 35, and a spring plate 38 of the restoring spring 19' is supported on the head 37. The restoring spring 19' rests on its other end on a housing part 39 in which both the control line 24' and the control chamber 23' are disposed. According to the invention, the face 34' is larger than the face 32, so that once again, as with the stepped piston of the first embodiment, a pressure step-up takes place. This second exemplary embodiment is distinguished by a particularly compact structure, with little idle volume. By dividing the blocking piston into two parts, a slight axial offset between the intermediate piston 31 and the control piston 33 is not disadvantageous, which is particularly favorable for the production cost. A stroke transducer, not shown in detail, is disposed in a window 41 of the housing 2'. Otherwise, this second exemplary embodiment functions like the first exemplary embodiment.

Although once again, the structure of the third exemplary embodiment shown in FIG. 3 is in principle like that of the first two exemplary embodiments, here the control device is used as a metering device for the fuel to be injected. Naturally the other two exemplary embodiments could be embodied this way, without having to alter the principle of the construction. Naturally, in the other two exemplary embodiments the fuel metering is tripped by other means, namely by the control slide 13 in the first exemplary embodiment, while in this third exemplary embodiment prolongations of the injection duration must be effected by other means, since the control device according to the invention is being used for metering the injection quantity.

In this third exemplary embodiment, the blocking piston is again embodied in two parts, with an intermediate piston 31' and a control piston 33'. With one end 42, the intermediate piston 31' protrudes into a blind bore 43 of the control piston 33' and has a collar 44 that cooperates as a stop with a housing part 36', on which the fitting 6'' that protrudes into the pump housing 1'' is disposed. The bore 45 receiving the intermediate piston 31' is also disposed in the housing part 36' and discharges directly into the pump work chamber 7''.

A flange 46 is present on the control piston 33' and serves as a support for the restoring spring 9'' that on its other end is supported on a housing part 9', which receives the control chamber 23'' and in which the control piston 33' is guided axially displaceably. In contrast to the other exemplary embodiments, the control valve 3'' here is open when without current; the movable valve element 25'' is therefore shown in the open state.

This third exemplary embodiment functions as follows:

Upon the compression stroke of the pump piston 4, the intermediate piston 31' and the control piston 33' are displaced upward counter to the force of the restoring spring 19''; fuel is positively displaced out of the control chamber 23'' via the control line 24''. Then as soon as the magnetic valve 3'' closes, that is, the movable valve element 25'' is attracted upward onto its seat, the remaining volume located in the control chamber 23'' is locked in, and as a result the intermediate piston 31' and the control piston 33' are prevented from moving upward. From this moment, the pressure required for the injection can build up in the pump work chamber 7'', after which the injection nozzle opens for the injection. Then as soon as the magnetic valve 3'' is switched off and the movable valve element 25'' is displaced downward and opens the control line 24'', the pressure located in the pump work chamber 7'' continues the deflection movement of the intermediate piston 31' and control piston 33', which results in an end of injection or supply to the engine. The onset and end of injection and hence the effective injection quantity are thus effected via the magnetic valve 3'' by suitable closure and reopening of the control line 24''. Because of the difference in size between the first face 32' on the intermediate piston 31' and the second face 34' on the control piston 33', the pressure in the control chamber 23' is only a small fraction of the pressure in the pump work chamber 7'' and so is controllable by the magnetic valve. Naturally the fuel quantity control can also be partly picked up by other control devices, for instance on the pump piston 4, so that especially at higher rpm there will be only one switching event of the magnetic valve per injection stroke. During the intake stroke of the pump piston 4, the fuel quantity prestored upstream of the intermediate piston 31' is pumped back, driven by the restoring spring 19'', into the pump work chamber 7''.

All the characteristics described in the specification, recited in the ensuing claims and shown in the drawing may be essential to the invention both singly and in any combination with one another.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, which comprises, a first housing;

an injection pump in said first housing for pumping fuel via at least one pressure line (8) to an injection nozzle from at least one pump work chamber (7) formed by a piston (4) in said first housing and an end of a fitting (6) of a second housing (2);

a metering device (13) for determining the injection quantity pumped from the pump work chamber to the injection nozzle;

a blocking piston (18) in said second housing which by means of a first face (29, 32) delimits a storage chamber (22) that is always connected to said pump work chamber (7) via a passage that extends from said pump work chamber (7) to said storage chamber (22) and fuel flow to and from said storage chamber (22) is permitted only through said passage, said blocking piston being displaceable within said second housing from a stop, counter to a restoring force (19) by fuel delivered from the pump work chamber into said storage chamber (22), said first face (29, 32) of said blocking piston being operative counter to said restoring force and a second face (34) of said blocking piston delimiting a control chamber (23) and being operative in a restoring direction of said restoring force;

a control line (24) of said control chamber (23) leads to a relief chamber (14) of lower pressure; and an electrically actuated control valve (3) in said control line (24);

said control valve (3) is an ON/OFF through valve; and said first face (29, 32) on said blocking piston (18, 31, 33) is smaller than said second face (34).

2. A fuel injection system as defined by claim 1, in which;

said connection from said pump work chamber (7) to said blocking piston (18) is direct and uncontrolled.

3. A fuel injection system as defined by claim 1, in which;

said blocking piston (18) is embodied as a stepped piston, and said first face serves as a step face (29).

4. A fuel injection system as defined by claim 1, in which;

said blocking piston comprises two individual pistons, an intermediate piston (31) and a control piston (33) which cooperate at their face ends, with longitudinal form-fitting, positive engagement and with mutually independent, radial guidance of the individual pistons (31, 33).

5. A fuel injection system as defined by claim 2, in which;

said blocking piston comprises two individual pistons, an intermediate piston (31) and a control piston (33) which cooperate at their face ends, with longitudinal form-fitting, positive engagement and with mutually independent, radial guidance of the individual pistons (31, 33).

6. A fuel injection system as defined by claim 1, in which;

said control valve (3) is embodied as a seat valve which closes in an outflow direction.

7. A fuel injection system as defined by claim 2, in which;

said control valve (3) is embodied as a seat valve which closes in an outflow direction.

8. A fuel injection system as defined by claim 3, in which;

said control valve (3) is embodied as a seat valve which closes in an outflow direction.

9. A fuel injection system as defined by claim 4, in which;

said control valve (3) is embodied as a seat valve which closes in an outflow direction.

10. A fuel injection system as defined by claim 6, in which;

said control valve (3) includes a movable valve element (25) which extends into the control chamber (23).

11. A fuel injection system as defined by claim 1, in which;

a helical spring (19) applies a restoring force on said blocking piston and said helical spring (19) at least indirectly engages said blocking piston (18, 42), and said blocking piston includes said second face (34).

12. A fuel injection system as defined by claim 11, which includes;

a stroke transducer (40) which detects a position location of said blocking piston (31, 33).

13. A fuel injection system as defined by claim 1, in which;

said blocking piston serves as a reservoir such that when the control valve (3) is opened, a corresponding fuel quantity, the volume of which is equivalent to the stroke of the blocking piston (18, 31) times the first face (29, 32) is permitted to flow to a low pressure suction chamber (14).

14. A fuel injection system as defined by claim 13, in which;

said control valve (3) is closed when without current applied thereto.

15. A fuel injection system as defined by claim 13, in which;

a return pumping pressure in chamber (22) determined by the restoring force of spring (19) and the first face (29, 32) is less than an opening pressure of an injection nozzle.

16. A fuel injection system as defined by claim 14, in which;

a return pumping pressure in chamber (22) determined by the restoring force of spring (19) and the first face (29, 32) is less than an opening pressure of an injection nozzle.

17. A fuel injection system as defined by claim 15, in which;

said return pumping pressure is greater than a closing pressure of the injection nozzle.

18. A fuel injection system as defined by claim 16, in which;

said return pumping pressure is greater than a closing pressure of the injection nozzle.

19. A fuel injection system as defined by claim 1, in which;

said blocking piston (31') and control valve (3'') serve as a metering device, in which control of a supply onset by blocking of said blocking piston during fuel pumping from said pump work chamber (7''), and a return pumping pressure determined by a restoring force spring (19'') and a first face (32') is less than both an opening pressure and a closing pressure of an injection nozzle.

20. A fuel injection system as defined by claim 19, in which;

opening up of the control valve (3'') affects an end of supply.

21. A fuel injection system as defined by claim 15, in which;

said blocking piston affects the end of supply by opening up a relief conduit.

22. A fuel injection system as defined by claim 15, in which;

said control valve (3'') is open when it is without current.

23. A fuel injection system as defined by claim 17, in which;

said control valve (3'') is open when it is without current.

24. A fuel injection system as defined by claim 19, in which;

said control valve (3'') is open when it is without current.

25. A fuel injection system as defined by claim 20, in which;

said control valve (3'') is open when it is without current.

26. A fuel injection system as defined by claim 21, in which;

said control valve (3'') is open when it is without current.

* * * * *